US005524537A

United States Patent [19]

van der Meulen

[11] Patent Number: 5,524,537

[45] Date of Patent: Jun. 11, 1996

[54] SQUEEGEE ASSEMBLY

[75] Inventor: Antonius M. van der Meulen, Helmond, Netherlands

[73] Assignee: Stork Screens, B.V., Boxmeer, Netherlands

[21] Appl. No.: 326,183

[22] Filed: Oct. 19, 1994

[30] Foreign Application Priority Data

Oct. 20, 1993 [NL] Netherlands ..... 9301820

[51] Int. Cl.[6] ..... B41L 13/18

[52] U.S. Cl. ..... 101/120; 101/167; 101/123; 118/413

[58] Field of Search ..... 101/120, 119, 101/123, 116, 167, 335; 118/413, 419, 261, 203, 118, 119, 104, 70; 15/245

[56] References Cited

U.S. PATENT DOCUMENTS

| | | | |
|---|---|---|---|
| 4,456,637 | 6/1984 | Takeda et al. | 118/118 |
| 4,518,637 | 5/1985 | Takeda et al. | 118/118 |
| 4,909,144 | 3/1990 | Doncher et al. | 101/123 |
| 5,095,816 | 3/1992 | Hasegawa et al. | 101/119 |
| 5,151,132 | 9/1992 | Zimmer | 101/120 |
| 5,376,177 | 12/1994 | Elvidge et al. | 118/410 |

FOREIGN PATENT DOCUMENTS

| | | | |
|---|---|---|---|
| 311291 | 10/1973 | Austria | B41F 15/42 |
| 2212920 | 9/1973 | Germany | B41E 15/42 |
| 469563 | 4/1969 | Switzerland . | |

*Primary Examiner*—Edgar S. Burr
*Assistant Examiner*—Daniel J. Colilla
*Attorney, Agent, or Firm*—Deveau, Colton & Marquis

[57] ABSTRACT

Squeegee assembly, in particular intended for coating an substantially cylindrical object, such as metal, seamless screen printing cylinders, with a liquid or pasty material, at least comprising two substantially annular squeegees arranged at a distance from each other, between which squeegees material metering means open out for metering a material to be applied to the object to be coated; which squeegees can form part of a wall which is resilient, at least in places, of an annular squeegee pressure chamber, which is provided with pressure fluid supply means, while an annular material-supply chamber may be present in the squeegee pressure chamber which is provided with openings which open out between the squeegees, and also comprises a material supply which can be connected to a material source.

14 Claims, 2 Drawing Sheets

SQUEEGEE ASSEMBLY

FIELD OF THE INVENTION

The present invention relates to a squeegee assembly, in particular intended for coating a substantially cylindrical object, such as metal, seamless screen printing cylinders, with a liquid or pasty material, at least comprising two substantially annular squeegees arranged at a distance from each other.

DESCRIPTION OF THE PRIOR ART

Such a squeegee assembly is known from the prior art and is frequently used in a coating device or also manually in order to provide substantially cylindrical objects with a coating of material. Such a squeegee assembly is used, for example, for coating a seamless metal rotary screen printing cylinder, which is, for example, a nickel cylinder having a wall thickness of between 50–500 microns and comprising 20–200 holes per running cm, with a lacquer. After such a screen printing cylinder has been coated, that is to say the lacquer coating on the dams between the holes has a specific layer thickness and a suitable depth of penetration into the holes, said lacquer coating is removed in accordance with the pattern, while the remaining areas are hardened. Such a screen printing cylinder is then ready for screen printing, in which case a dye is pressed on a substrate to be printed through the open holes by means of an internal squeegee, as known from the prior art.

The coating of cylindrical objects with the aid of the known squeegee assembly has a number of important disadvantages. Firstly, the displacement of such a squeegee along the cylindrical object has to be carried out in a very accurate manner, as differences in layer thickness and penetration depth of the material to be applied occur in the case of even the smallest eccentricity between the squeegee and the object. Furthermore, the choice of the shape of the squeegee and its rigidity, as well as the choice of the lacquer are relatively complicated and dependent on many factors.- The layer thickness and penetration depth of the material to be applied to, for example, a screen printing cylinder are dependent on the rigidity of the squeegee, the speed of displacement of the squeegee and the properties of the lacquer, such as viscosity, solids content, surface tension, etc. Finally, supplying the material to be applied to the object to the squeegee assembly is an operation which is difficult to regulate and is carried out manually, so that it requires a skilful operator. In most cases, an excess amount of material is supplied between the squeegees, which causes substantial problems when it is removed after the coating operation. In both operations, material can easily be spilt on the object which has just been coated, with all the consequences this entails. In addition, the object to be coated always has to be coated in an substantially vertical position.

SUMMARY OF THE INVENTION

The object of the present invention is to provide a solution to the abovementioned disadvantages and is for this purpose characterized in that material-metering means open out between the squeegees for metering a material to be applied to the object to be coated. This offers the advantage that residues of material remaining between the squeegees after coating can easily be removed, for example through suction, via the material- metering means.

According to a second aspect of the invention, the squeegees form part of a wall which is resilient, at least in places, of an annular squeegee pressure chamber, which is provided with pressure fluid supply means.

The squeegee assembly according to the invention is very flexible with regard to its application, since it is suitable for coating a cylindrical object in two directions, while, in contrast with the prior art, the object can also be coated at an angle or even in a horizontal position. By controlling the pressure fluid supply to the squeegee pressure chamber, the pressing force of the squeegees can be controlled in a suitable manner, while the material-metering means, in combination with the latter, allow the squeegee assembly to apply virtually any liquid or pasty material, regardless of the respective properties, with a desired layer thickness, and, in the case of screen printing cylinders, with a desired penetration depth.

Preferably, the material-metering means are designed in the form of an annular material-supply chamber located inside the squeegee pressure chamber and provided with openings which open out between the squeegees and furthermore comprises a material supply which can be connected to a material source. This embodiment offers the possibility of spreading the material to be applied to the cylindrical object very evenly over the entire circumference between the squeegees.

Advantageously, the squeegee pressure chamber comprises a partition wall, which divides this pressure chamber into a first and a second squeegee pressure chamber in such a manner that each squeegee forms part of the wall of one of the two pressure chambers, while each pressure chamber is provided with pressure fluid supply means. Thus, the squeegee pressure chamber is divided into two annular pressure chambers which can each interact with one of the squeegees so that, by means of the suitable control of the respective pressure fluid supply, each squeegee can be pressed against the surface of the cylindrical object to be coated with a force which is substantially independent of the other squeegee.

The squeegees provided in the squeegee assembly according to the invention are preferably annular squeegees, having an substantially circular cross section, although, in certain cases, a lip-shaped or other cross section may also be preferred. In addition, more than two squeegees, if desired with a plurality of material-supply chambers, can be used with a corresponding number of metering openings.

The production of the squeegee assembly can be appreciably simplified if the squeegees with at least the section, located between the latter, of the wall of the squeegee pressure chamber, and the material-supply chamber are integrally formed. Said components can then be produced using suitable techniques, such as, for example, injection moulding or the like. In general, these components will be made of a plastic or rubber-like material.

In particular, the squeegees with at least the section, located between the latter, of the wall of the squeegee pressure chamber, the material-supply chamber and the partition wall are integrally formed.

The levelling faces of the squeegees, which are in contact with the surface of the object to be coated, are subject to wear. Therefore, it is particularly preferable to provide the squeegees with wear-resistant means, at least on the levelling face thereof. Said means may consist of, for example, a surface coating, but are preferably in the form of helical reinforcing elements extending in the radial direction and embedded in the squeegees, said elements, at least in places, forming a part of the levelling face of the respective squeegee.

The squeegee assemblies according to the invention are self-centering, as the squeegees can be displaced in the radial direction relative to the pressure chamber due to the wall being resilient in places, while an axial displacement is essentially prevented.

Below, the invention will be described in more detail with reference to the accompanying drawings.

DESCRIPTION OF THE PREFERRED EMBODIMENTS

Figure 1:
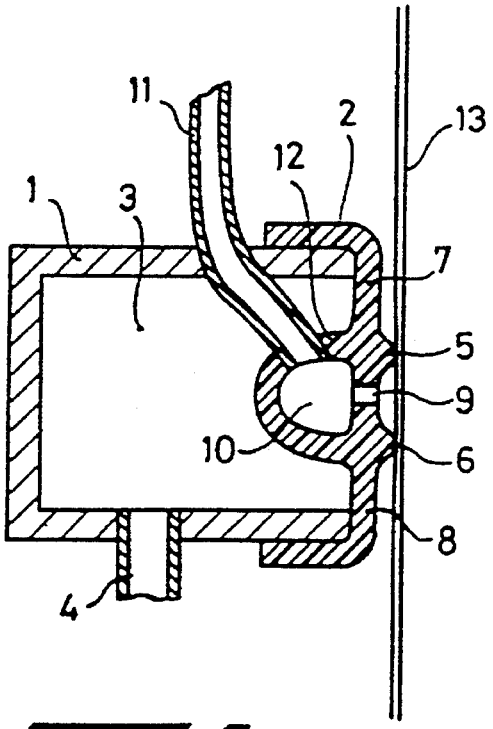
FIG. 1 shows a first embodiment of a squeegee assembly according to the invention.

In FIG. 1, the squeegee assembly comprises a wall 1 which, together with a rubber squeegee profile 2, delimits a squeegee pressure chamber 3. Said chamber 3 is provided with a pressure fluid supply 4.

The squeegee profile 2 comprises two squeegees 5 and 6 as well as two resilient parts 7 and 8 which serve as squeegee centering means. A material-metering opening 9 is provided between the squeegees, which opening 9 opens out into a material-supply chamber 10 provided with a material supply 11. Said material-supply chamber 10 comprises a wall 12 which is integrally formed with the squeegee profile 2. A wall of a rotary screen printing cylinder designated by 13 serves as an example of an substantially cylindrical object to be coated.

The squeegee assembly as shown in FIG. 1 can be incorporated in a suitable coating device, in which said assembly can be mounted in said device with the aid of mounting means, while mounting means can be displaced along an object to be coated with the aid of displacement means. Said displacement means are designed, for example, as a driven chain with sprocket wheels, or also hydraulic displacement means.

Using the assembly according to the invention, it is possible, having selected a specific material to be applied and having determined the final layer thickness on the object to be coated, to provide said coating on the cylinder 13 at a relatively high speed by adjusting the fluid pressure in the chamber 3 as well as the supply speed and thus the pressure of the material to be applied in the chamber 10. In particular, it is advantageous, in the case of rotary screen printing cylinders which have been provided with a hole pattern, to be able to control the supply pressure of the material in order to be able to control the depth of penetration into the holes.

Subsequent to a coating operation executed using the squeegee assembly according to the invention, material remaining between the squeegees can easily be removed through suction via the material supply 11.

Figure 2:
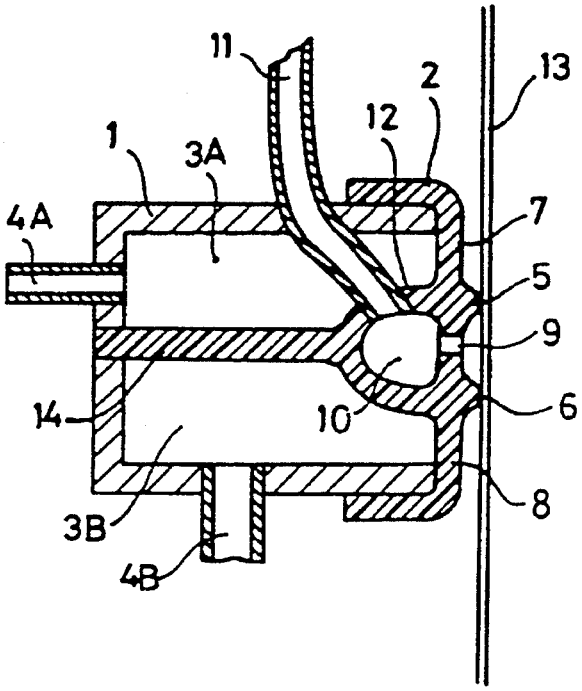
FIG. 2 shows another embodiment of the squeegee assembly having a partition wall in the squeegee pressure chamber.

FIG. 2 shows a modified embodiment of the squeegee assembly according to FIG. 1, in which an additional pressure chamber partitioning wall 14 is present, which divides the pressure chamber 3 into two chambers 3A and 3B, both of which are provided with pressure fluid supplies 4A and 4B, respectively. By means of this embodiment, it is possible to adjust the pressing force of the two squeegees 5 and 6 independently of each other by suitable control of the pressure of the pressure fluid in the chambers 3A and 3B. Thus, it can be advantageous, in the case of a coating in a specific direction, to have a lower pressing force act on the front squeegee, viewed in the direction of displacement, than on the rear squeegee, which will ultimately determine the layer thickness.

As is obvious from the figure, the partition wall 14 is preferably integrally formed with the material-supply chamber 10, the squeegees 5 and 6 and the remaining part of the squeegee profile 2.

Figure 3:
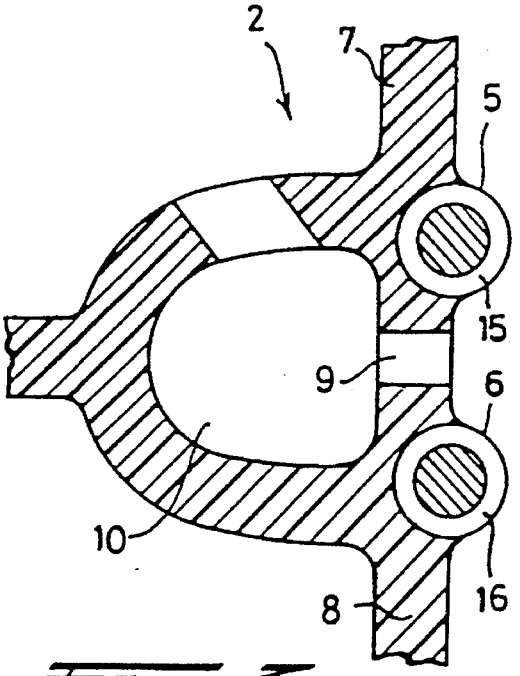
FIG. 3 shows a diagrammatic cross section of a squeegee assembly according to the invention having wear-resistant means in the squeegees.
Figure 4:
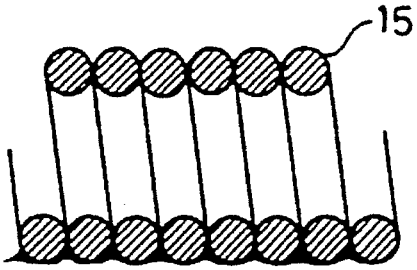
FIG. 4 shows a diagrammatic cross section of a helical reinforcing element.
Figure 5:
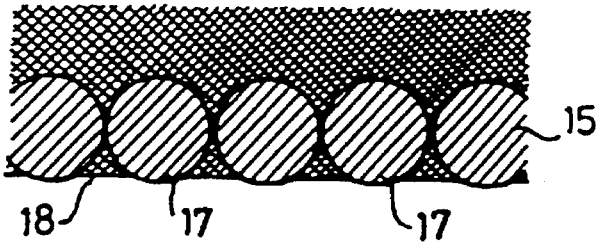
FIG. 5 shows an enlargement of said reinforcing element embedded in a squeegee.

FIG. 3 diagrammatically shows a partial cross section of a part of the squeegee profile 2, in which the squeegees 5 and 6 are provided with wear-resistant means in the form of two helical reinforcing elements 15 and 16, which are shown in more detail in FIG. 5. FIG. 4 shows that said reinforcing element is helical, and FIG. 5 clearly shows that said reinforcing element forms a part of the levelling face 18 of the squeegee, at least in places, as is indicated by 17.

Obviously, said wear-resistant means can also be designed in a different manner, for example, in the form of a wear-resistant coating or a large number of embedded rings placed against one another which, in places, form a part of the levelling face of the squeegee in the same manner as shown in FIG. 5.

Figure 6:
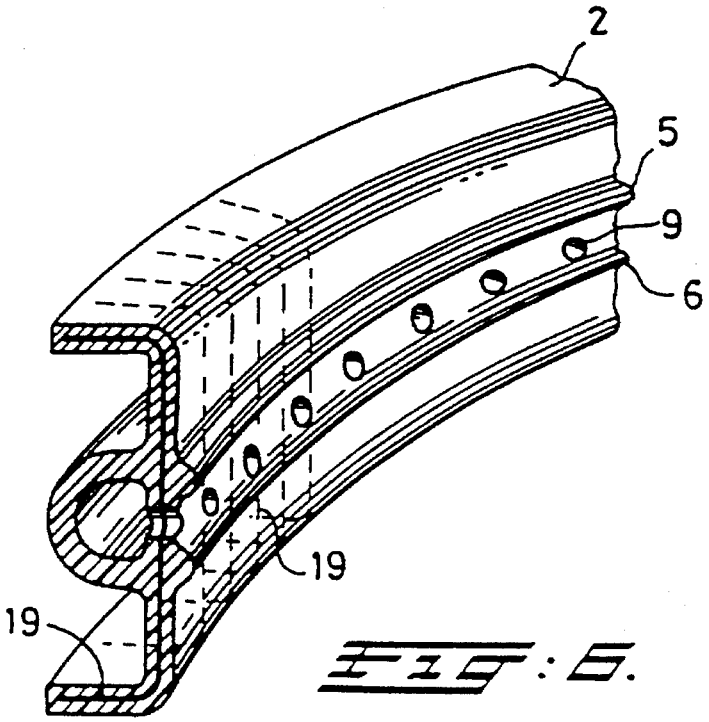
FIG. 6 shows a perspective view of a part of the squeegee assembly according to the invention having reinforcing wires.

Finally, FIG. 6 shows a part of a squeegee profile according to the invention in which the accommodation of reinforcing wires 19 is shown diagrammatically by means of dotted lines. The purpose of said wires is to prevent an axial displacement of the squeegees 5 and 6 relative to each other and relative to the pressure chamber 3, while permitting a radial displacement, which makes the squeegees self-centering relative to the object to be coated.

What is claimed is:

1. A squeegee assembly for coating a substantially cylindrical object comprising:

a squeegee pressure chamber defined by a pressure chamber wall, including a resilient portion said pressure chamber being provided with a pressure fluid supply means;

a material supply chamber located inside said pressure chamber and defined by a resilient supply chamber wall and by a portion of said resilient pressure chamber wall, said material supply chamber being provided with a material supply means;

at least two squeegees attached to said resilient portion of said pressure chamber wall, said squeegees being arranged a distance away from each other; and material metering means formed in said resilient portion of said pressure chamber wall between said squeegees for metering material from said material supply chamber onto the object to be coated.

2. The squeegee assembly according to claim 1, wherein said pressure chamber comprises a partition wall which divides said pressure chamber into a first and a second pressure chamber, wherein each pressure chamber is provided with a pressure fluid supply means, and wherein said resilient portion of said pressure chamber wall has a first part which forms a wall of said first pressure chamber and a second part which forms a wall of said second pressure chamber, and wherein one of said squeegees forms a portion of said wall of said first pressure chamber and wherein the other squeegee forms a portion of said wall of said second pressure chamber.

3. The squeegee assembly according to claim 2, wherein said resilient portion of said pressure chamber wall, said resilient supply chamber wall and said squeegees are integrally formed.

4. The squeegee assembly according to claim 1, wherein said resilient portion of said pressure chamber wall, said resilient supply chamber wall and said squeegees are integrally formed.

5. The squeegee assembly according to claim 1, wherein each of said squeegees has a leveling face and wherein said squeegees comprise wear-resistant means on the leveling faces thereof.

6. The squeegee assembly according to claim 5, wherein said wear-resistant means comprises helical reinforcing elements extending in the radial direction and embedded in said squeegees, wherein said reinforcing elements form a part of the leveling face of each squeegee.

7. The squeegee assembly according to claim 1, wherein reinforcement wire or fibers are embedded in the squeegees in the axial direction.

8. A squeegee assembly for coating a substantially cylindrical object comprising:

a squeegee pressure chamber defined by a pressure chamber wall including a resilient portion, said pressure chamber being provided with a pressure fluid supply means;

a material supply chamber located inside said pressure chamber and defined by a resilient supply chamber wall and by a portion of said resilient pressure chamber wall, said material supply chamber being provided with a material supply means;

at least two substantially annular squeegees attached to said resilient portion of said pressure chamber wall, said squeegees being arranged a distance away from each other; and material metering means formed in said resilient portion of said pressure chamber wall between said squeegees for metering material from said material supply chamber onto the object to be coated.

9. The squeegee assembly according to claim 8, wherein said pressure chamber comprises a partition wall which divides said pressure chamber into a first and a second pressure chamber, wherein each pressure chamber is provided with a pressure fluid supply means, and wherein said resilient portion of said pressure chamber wall has a first part which forms a wall of said first pressure chamber and a second part which forms a wall of said second pressure chamber, and wherein one of said squeegees forms a portion of said wall of said first pressure chamber and wherein the other squeegee forms a portion of said wall of said second pressure chamber.

10. The squeegee assembly according to claim 8, wherein said resilient portion of said pressure chamber wall, said resilient supply chamber wall and said squeegees are integrally formed.

11. The squeegee assembly according to claim 8, wherein said resilient portion of said pressure chamber wall, said resilient supply chamber wall and said squeegees are integrally formed.

12. The squeegee assembly according to claim 8, wherein each of said squeegees has a leveling face and wherein said squeegees comprise wear-resistant means on the leveling faces thereof.

13. The squeegee assembly according to claim 12, wherein said wear-resistant means comprises helical reinforcing elements extending in the radial direction and in embedded in said squeegees, wherein said elements form a part of the leveling face of each squeegee.

14. The squeegee assembly according to claim 8, wherein reinforcement wire or fibers are embedded in the squeegees in the axial direction.

* * * * *